United States Patent [19]

Senor et al.

[11] 4,167,721

[45] Sep. 11, 1979

[54] HERMETIC MOTOR PROTECTOR

[75] Inventors: Ronald E. Senor, North Attleboro, Mass.; Jan A. Abcouwer, Almelo, Netherlands

[73] Assignee: Texas Instruments Incorporated, Dallas, Tex.

[21] Appl. No.: 833,408

[22] Filed: Sep. 15, 1977

[51] Int. Cl.[2] ..... H01H 37/04; H01H 37/54

[52] U.S. Cl. ..... 337/112; 337/372; 337/380

[58] Field of Search ..... 337/112, 113, 100, 102, 337/89, 380, 365, 372

[56] References Cited

U.S. PATENT DOCUMENTS

| | | | |
|---|---|---|---|
| 3,453,577 | 1/1969 | D'Entremont | 337/100 |
| 3,959,762 | 5/1976 | Senor | 337/102 |

*Primary Examiner*—Harold Broome

*Attorney, Agent, or Firm*—John A. Haug; James P. McAndrews

[57] ABSTRACT

A thermally responsive motor protector device particularly adapted for protecting a small electrical motor against both overcurrent and overtemperature conditions in an environment requiring hermetic sealing of the protector has a structure which provides the device with the desired hermetic seal and with a very small thermal mass for achieving the desired speed of response to overcurrent and overtemperature conditions in a small motor while also permitting mass production and automatic calibration of the device at low cost and inexpensive installation of the device without risk of loss of calibration.

6 Claims, 3 Drawing Figures

HERMETIC MOTOR PROTECTOR

Electrical motors used in refrigeration compressors and the like are commonly operated within sealed containers with coolant fluids surrounding the motors. Motor protector devices which are sealed to exclude such coolant fluids are commonly arranged to be thermally responsive both to the temperature of the motor windings and to the current flow in the windings, whereby the protectors are adapted to carry normal motor currents but are adapted to heat up and to interrupt motor operation on the occurrence of either overcurrent or overtemperature conditions in the windings. In these applications, the protector devices must heat up and interrupt motor operation very rapidly on the occurrence of overcurrent conditions due to locked rotor conditions or the like in the motors. In addition, the protectors also have to be responsive to the usually slower build-up of motor winding temperatures due to the more prolonged occurrence of lower overcurrents or to other fault conditions.

Design improvements and new applications in the refrigeration compressor field as well as in other fields are resulting in the use of increasingly smaller and less expensive motors for various purposes and it has become increasingly difficult to provide motor protectors which are adapted to carry the normal currents in the motors while also displaying the desired speed of response to both overcurrent and overtemperature conditions in the smaller motors. It has been particularly difficult to provide such motor protectors which are adapted to be manufactured, calibrated and installed at costs which are compatible with the lower motor costs.

It is an object of this invention to provide a novel and improved motor protector device which is particularly adapted for protecting a relatively small electrical motor; to provide such a protector which is hermetically sealed for use within a motor winding where the motor is surrounded by a coolant fluid; to provide such a sealed protector which has a sufficiently small thermal mass to be promptly responsive to the overcurrent conditions in smaller electrical motors while also being properly responsive to the occurrence of overtemperature conditions in such motors; to provide such a protector device which is adapted for manufacture and calibration at low cost; and to provide such a device which is easily and economically installed without risk of loss of calibration.

Briefly described, the novel and improved motor protector of this invention comprises a deformable, cup-shaped, metal housing having an open end and having a rim around its open end. A thermally responsive snap-acting, electrically conductive bimetallic element has one end secured to the bottom of the housing so that the element extends in cantilever relation from the housing bottom inside the housing. The bimetallic element carries a movable contact at the distal end of the element. The protector further includes an electrically conductive metal header plate having an opening in the plate, a terminal stud of selected diameter sealed in the plate opening by an electrically insulating glass which is fused to both the stud and the plate, and a complementary contact, preferably of larger diameter than the stud, secured to one end of the stud adjacent one side of the plate. The diameter of the plate opening filled with the insulating glass is selected to assure the necessary electrical spacing between the complementary contact and the header plate and preferably the complementary contact is spaced from the glass sealant to facilitate assembly and to improve service life. The header plate is also formed of relatively thin material to achieve a desired small thermal mass and has a flange around the plate opening extending from the opposite side of the plate, whereby a sufficient areas of the plate flange material is fused to the glass sealant to assure proper sealing and securing of the terminal stud in the plate opening. Preferably a terminal portion of the plate is arranged to extend from an edge of the header plate. The rim of the cup-shaped housing is welded to said one side of the header plate for enclosing both the bimetallic element and the device contacts in sealed relation within the device. In this arrangement, the housing member is readily deformed for engaging the movable contact carried by the bimetallic element with the complementary contact carried by the stud terminal so that a circuit is normally closed between the stud terminal and the plate terminal portion when a normal motor current is directed through said circuit but so that the bimetallic element is calibrated to move with snap action to disengage the contacts for opening the noted circuit when the element is heated to a selected temperature either in response to the occurrence of an overload current in the circuit or in response to heat transferred to the element from an overheating winding of the motor. The protector device is of very compact construction and has a relatively small thermal mass. Thus the device is easily accommodated within a winding of a small motor to be connected in series with the winding but is adapted to be promptly responsive to both overcurrent and over temperature conditions in the winding. The device terminals are also located such that winding leads are easily welded to the terminals without tending to result in any overheating of the bimetallic element such as would risk loss of the calibration of the element. Further the device is adapted for economical manufacture and for automatic calibration so that the cost of the device is compatible with the cost of the motor it is adapted to protect.

Other objects, advantages and details of the motor protector of this invention appear in the following detailed description of preferred embodiments of the invention, the detailed description referring to the drawings in which.

Figure 1:
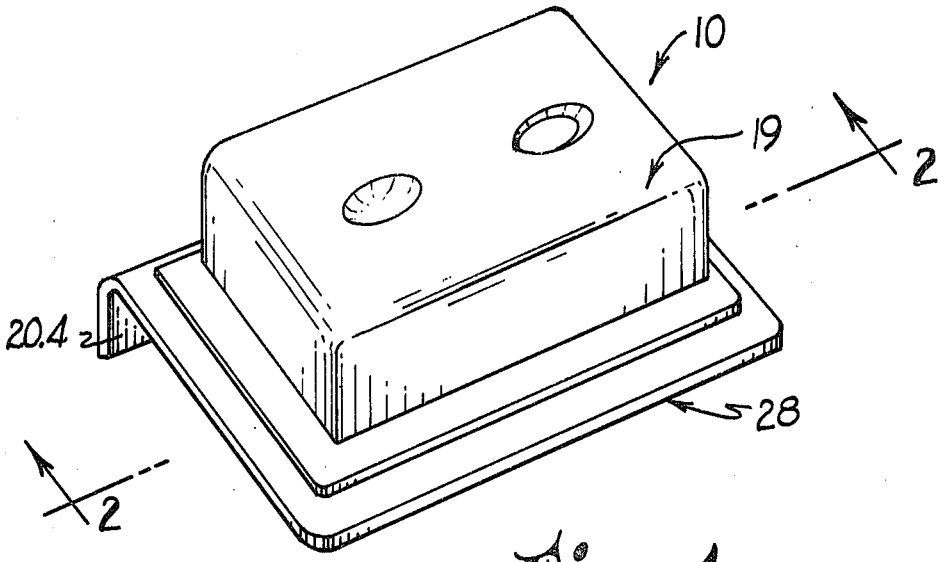
FIG. 1 is a perspective view of the motor protector of this invention.

Referring to the drawings, 10 in FIGS. —3 indicates the novel and improved motor protector of this invention which is shown to include a generally rectangular, cup-shaped housing member 12 formed of a deformable, electrically and thermally conductive metal material such as low carbon or cold rolled steel or the like. The housing has a bottom 12.1, side walls 12.2, an open end 12.3, and a rim 12.4 around the open end, the rim preferably being flared outwardly as shown and having a sharp edge 12.5 for use in welding the housing to a header as discussed below. The housing is preferably formed of a material which is easily and reliably welded and which has a selected electrical conductivity such that the housing material will carry a selected electrical current without excessive power loss but will tend to generate a selected heat when a relatively larger current is directed through the housing. Preferably the housing member is deformed to provide a weld projection 12.6 and to form a stop 12.7 which are further discussed below.

A conventional, electrically conductive, snap-acting bimetallic element 14 is secured at one end 14.1 to the bottom of the housing so that the element extends in cantilever relation from the housing bottom inside the cup-shaped housing, the element having a movable electrical contact 16 welded or otherwise secured to the distal end 14.2 of the element. Typically, for example, the element has an aperture in one element end 14.1 and a weld button 18 having a head 18.1 and a shank 18.2 has its head resistance welded to the element end 14.1 and has its shank extending through the element aperture (not shown) to be resistance welded to the weld projection 12.6 on the housing bottom. The resulting housing assembly 19 is adapted to be manufactured automatically at very low cost.

In accordance with the invention, the motor protector 10 also includes an electrically and thermally conductive header plate 20 which is formed of a relatively thin, electrically and thermally conductive material such as low carbon or cold rolled steel or the like. The plate has an aperture 20.1 therein and has a flange 20.2 depending from the plate around the perimeter of the aperture. A terminal stud 22 of a selected, relatively small diameter is extended through the aperture and a complementary electrical contact 24 is welded or otherwise secured to one end of the stud adjacent one side 20.3 of the header plate. Preferably also the header plate has a terminal portion 20.4 depending from one edge of the plate. An electrically insulating glass sealant material 26 is disposed in the header aperture and is fused to the stud 22 and to the header plate flange 20.2 for sealing the plate aperture and for securing the stud terminal within the plate aperture, thereby to form the header plate assembly 28. As will be understood, the header assembly 28 is also adapted for automatic manufacture at low cost. In accordance with the invention, the complementary contact 24 has a relatively larger diameter than the stud terminal while the plate aperture 20.1 is of relatively larger diameter than the complementary contact for providing a desired electrical spacing between the complementary contact and the header plate. Preferably also in contact 24 as secured to the stud terminal is spaced slightly from the glass sealant as indicated at 31 to facilitate assembly by avoiding any weld flashing where the contact is welded to the stud. This structure also tends to shield the glass sealant from some of the heat generated during contact opening for improving service life of the motor protector. In this header assembly, the flange 20.2 adds rigidity to the header plate which is preferably kept thin to reduce its thermal mass and also assures that the glass sealant 26 engages sufficient areas of the header plate and stud terminal surfaces for assuring reliable sealing of the plate aperture and secure mounting of the stud terminal in the aperture.

Figure 2:
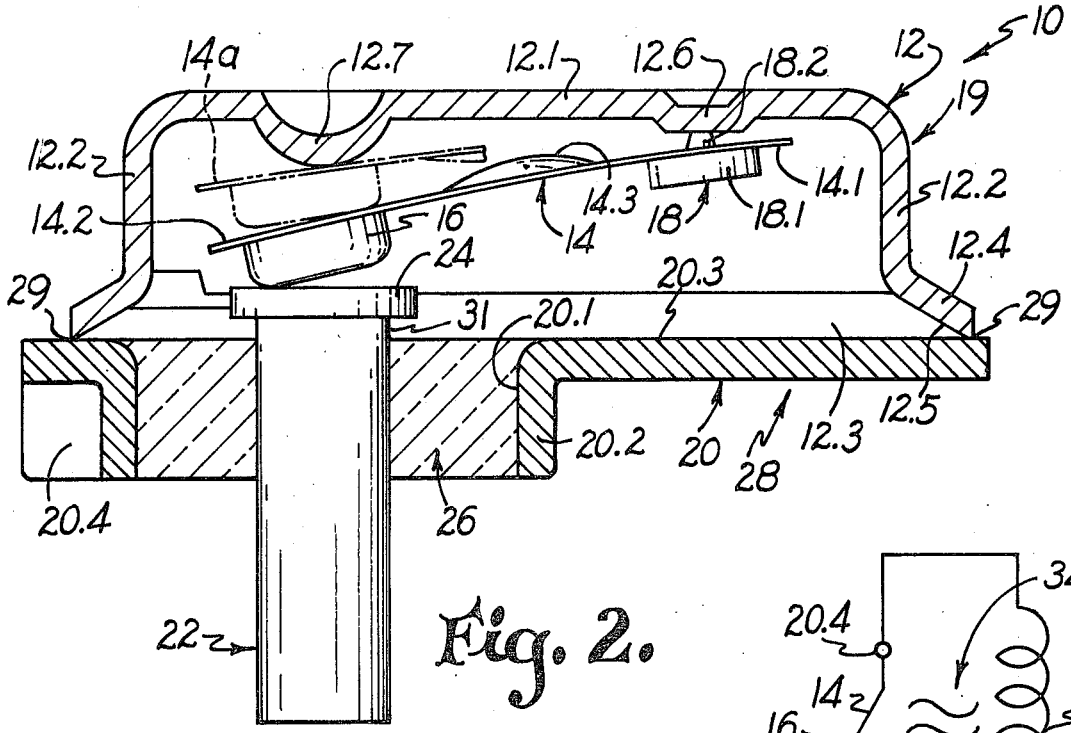
FIG. 2 is a section view to enlarged scale along line 2—2 of FIG. 1.

The rim of the housing member is welded to said one side 20.3 of the header plate as indicated at 29 for enclosing and hermetically sealing the bimetallic element and the device contacts within the housing. The flare and the sharp edge of the housing rim facilitate this welding of the housing to the header plate by conventional resistance welding techniques. The housing is then deformed, preferably at the location of the weld projection 12.6 where the bimetallic element 14 is secured to the housing bottom, for adjusting the position of the bimetallic element and the movable contact carried by the element so that the movable contact 16 normally engages the complementary contact 24 to close an electrical circuit between the terminals of the protector device as constituted by the stud terminal 22 and the terminal portion 20.4 of the header plate. This deformation of the housing is regulated for calibrating the motor protector in a conventional manner. That is, where the conventional bimetallic element has a dished portion 14.3 therein normally located at one side of the element is shown in solid lines, in FIG. 2, the element is positioned by the deformation of the housing to normally engage the device contacts with a selected contact pressure but is adapted to move with snap-action to the second position shown in broken lines **14*a* in FIG. 2 when the element is heated to a selected temperature, whereby the dished portion of the element snaps to the opposite side of the element, the element moves with snap action against the housing stop 12.7, and the device contacts 16 and 24 are rapidly disengaged for opening the noted circuit. As will be understood the assembly and calibration of the motor protector 10** is also adapted to be carried out automatically at a very low cost.

Figure 3:
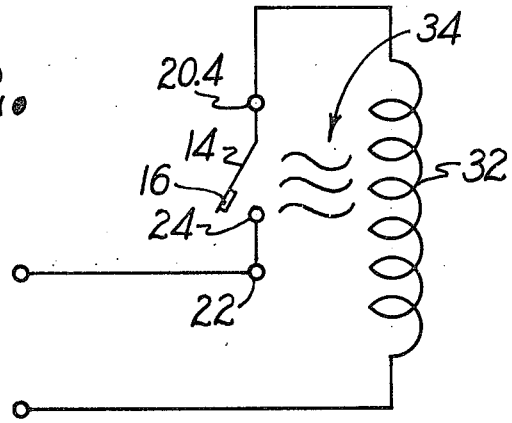
FIG. 3 is a schematic diagram illustrating use of the motor protector of this invention in protecting a winding of a small electrical motor.

In this arrangement, the motor protector 10 is easily positioned within a motor winding 32 and electrically connected in series with the winding as is schematically illustrated in FIG. 3, whereby the motor protector device is adapted to protect the motor against the occurrence of overcurrent or overtemperature conditions in the winding. The protector terminals 22 and 20.4 are conveniently located to be welded or otherwise secured to the motor winding leads without tending to cause any overheating of the bimetallic element during the welding such as would result in loss of the calibration of the protector. The motor protector is easily made of a very small size to be readily accommodated within the winding of a small electrical motor to be in excellent heat-transfer relation to the motor as is schematically illustrated at 34 in FIG. 3. However, the arrangement of the complementary contact relative to the glass sealant permits relatively large electrical spacings to be provided to achieve desired device capacity. The use of the relatively large complementary contact and the glass sealing arrangement permit easy registration of the device contacts during assembly so that the protector is conveniently assembled and calibrated with a high production yield resulting in reduced device cost. The protector has a very small thermal mass and the protector circuit directs current flow through a large part of the device so that heating of the device to its actuating temperature can be accomplished at relatively low overcurrents such as would be encountered in small motors. The small thermal mass of the protector also permits the device to be rapidly responsive to the occurrence of overtemperature conditions in the motor winding. Typically, for example, the motor protector 10 has a length of about ⅝ inches (16.1 mm), a width of about 7/16 inches (10mm) and a thickness of about 1/4 inch (6.25 mm) excluding extensions of the stud terminal. However the protectors are useful in a wide variety of applications which require rates of temperature rises from 0.3° C. per second to about 7° C. per second in response to overcurrent conditions and are particularly suitable for use in protecting a wide variety of small electrical motors having ratings on the order of ⅓ horsepower or the like.

It should be understood that although particular embodiments of the motor protector of this invention have been described by way of illustrating the invention, this invention includes all modifications and equivalents of the disclosed embodiments falling within the scope of the appended claims.

We claim:

1. A thermally responsive motor protector comprising a cup-shaped electrically and thermally conductive housing having an open end, a thermally responsive electrically conductive bimetallic element secured at one end to the housing to extend in cantilever relation therefrom inside the housing, said element carrying a moveable contact at its distal end and being adapted to move from a first position to a second position in response to heating of the element to a selected temperature, and an electrically and thermally conductive metal header plate secured in sealed relation to the housing over the open housing end, said plate having an opening therein, having a stud terminal of selected diameter extending through said opening, having a complementary electrical contact of relatively larger diameter secured to one end of the stud terminal in coaxial relation to the stud terminal at one side of the plate to be engaged by the moveable contact for closing a cricuit between the stud terminal and the plate when the bimetallic element is in the first position thereof and to be disengaged from the moveable contact for opening said circuit when the bimetallic element is in the second position thereof, and having an electrically insulating glass sealant material fused to the stud terminal and plate within the plate opening for sealing the opening and securing the stud terminal in the opening, said plate opening having a relatively larger diameter than said complementary contact so that said glass sealant material provides a selected electrical spacing between the complementary contact and the plate.

2. A motor protection as set forth in claim 1 having a terminal portion depending from one edge of said header plate in selected spaced relation to said plate opening.

3. A thermally responsive motor protector comprising a cup-shaped electrically and thermally conductive housing having an open end, a thermally responsive electrically conductive bimetallic element secured at one end to the housing to extend in cantilever relation therefrom inside the housing, said element carrying a moveable contact at its distal end and being adapted to move from a first position to a second position in response to heating of the element to a selected temperature, and an electrically and thermally conductive metal header plate secured in sealed relation to the housing over the open housing end, said plate having an opening therein, having a stud terminal of selected diameter extending through said opening, having a complementary electrical contact of relatively large diameter secured to one end of the stud terminal at one side of the plate to be engaged by the moveable contact for closing a circuit between the stud terminal and the plate when the bimetallic element is in the first position thereof and to be disengaged from the moveable contact for opening said circuit when the bimetallic element is in the second position thereof, and having an electrically insulating glass sealant material fused to the stud terminal and plate within the plate opening for sealing the opening and securing the stud terminal in the opening, said plate opening having a relatively larger diameter than said complementary contact so that said glass sealant material provides a selected electrical spacing between the complementary contact and the plate, said heater plate has a flange depending therefrom around said plate opening and said glass sealant material is fused to said stud terminal and to said flange for securely mounting and sealing the stud terminal in said plate opening.

4. A motor protector as set forth in claim 1 wherein said complementary contact is secured to said one end of said stud terminal in selected spaced relation to said glass sealant material for tending to shield the glass sealant material from excessive heating thereof during opening and closing of said circuit.

5. A thermally responsive motor protector comprising a cup-shaped, electrically and thermally conductive, deformable metal housing having a bottom, side walls and an open end, and having a flared rim extending around said open end, a thermally responsive electrically conductive snap-acting bimetallic element secured at one end to the housing bottom to extend in cantilever relation therefrom inside the housing, said element carrying a moveable electrical contact at its distal end and being moveable with snap-action from a first position to a second position in response to heating of the element to a selected temperature, and an electrically and thermally conductive metal header plate welded in sealed relation to the flared housing rim over the open end of the housing, said plate having an opening therein and having a flange depending therefrom around the perimeter of the opening, having a stud terminal of selected diameter extending through said opening, having a complementary electrical contact of relatively larger diameter secured to one end of the stud terminal spaced from one side of the plate to be engaged by the moveable contact for closing a circuit between the stud terminal and header plate when the bimetallic element is in said first position thereof and to be disengaged from the moveable contact for opening said circuit when the element is in said second position thereof, and having an electrically insulating glass sealant material fused to the stud terminal and to the plate flange within said plate opening in spaced relation to the complementary contact for sealing the opening and securing the stud terminal in the opening, said plate opening having a relatively larger diameter than said complementary contact so that said glass sealant material provides a selected electrical spacing between the complementary contact and the header plate.

6. A motor protector as set forth in claim 5 wherein said header plate has a terminal portion thereof depending from one edge of the plate in selected spaced relation to said plate opening.

* * * * *